US005901687A

United States Patent [19]

Tasaki et al.

[11] Patent Number: 5,901,687

[45] Date of Patent: May 11, 1999

[54] CASSETTE-TYPE FUEL TANK AND WORKING MACHINE PROVIDED WITH THE SAME

[75] Inventors: Takanobu Tasaki, Tokyo; Yoshiaki Hironaka, Saitama; Yoshihiro Tanaka, Okayama, all of Japan

[73] Assignee: Kioritz Corporation, Tokyo, Japan

[21] Appl. No.: 09/040,751

[22] Filed: Mar. 18, 1998

[30] Foreign Application Priority Data

Mar. 28, 1997 [JP] Japan ..... 9-77397

[51] Int. Cl.[6] ..... F02M 37/04; B65D 51/16

[52] U.S. Cl. ..... 123/516; 220/367.1

[58] Field of Search ..... 123/516, 527; 220/562, 4.14, 4.15, 367.1, 368, 373, 905

[56] References Cited

U.S. PATENT DOCUMENTS 5,799,640 9/1998 Sugimoto et al. ..... 123/527

5,816,430 10/1998 Gruber ..... 220/367.1

FOREIGN PATENT DOCUMENTS 1127966 8/1989 Japan .

1141364 9/1989 Japan .

*Primary Examiner*—Thomas N. Moulis

*Attorney, Agent, or Firm*—Baker & Botts, L.L.P.

[57] ABSTRACT

A cassette-type fuel tank can be removably mounted on a working machine equipped with an internal combustion engine. The fuel tank has an opening to which different closing caps can be selectively and removably attached. One cap is for use in transporting the fuel tank separate from the working machine, and another is for use when the fuel tank is attached to the working machine. The working machine has a tank-mounting means for removably holding the fuel tank below the internal combustion engine.

8 Claims, 5 Drawing Sheets

CASSETTE-TYPE FUEL TANK AND WORKING MACHINE PROVIDED WITH THE SAME

BACKGROUND OF THE INVENTION

This invention relates to a fuel tank for gasoline or the like, which is suited for use in a portable working machine equipped with an internal combustion engine, and relates also to a portable working machine which is removably equipped with such a fuel tank.

For a portable working machine powered by an internal combustion engine, it has been proposed to use a plurality of fuel tanks prepared in advance, with each tank being different in volumetric capacity and containing a suitable quantity of fuel in conformity with anticipated work time, and being adapted to be easily and removably attached to the portable working machine, thereby alleviating the burden on the operator and improving work efficiency (Japanese Utility Model Unexamined Publication H/1-127966).

When the fuel, e.g. gasoline in the tank of the working machine is exhausted during operation of the working machine, handling in replenishing the tank with fuel is troublesome. With a view to solving this problem, it has been proposed to prepare in advance a suitable number of spare tanks filled with fuel, for ready exchange for refueling when the working machine has run out of fuel. As a result, since resupplying the working machine with fuel is effected readily through replacement of the fuel tank, attendant handling is made simple and easy.

However, this leaves unaddressed problems with attaching a fuel tank to the working machine, and with transporting and storing individual fuel tanks.

There is a further difficulty in connecting a fuel supply pipe between the fuel tank and a carburetor after attachment of the fuel tank to the working machine.

Furthermore, problems remain due to the generation of negative pressure inside the fuel tank as the volume of fuel therein is reduced by consumption or withdrawal of fuel from the fuel tank, resulting in inconvenience in use.

SUMMARY OF THE INVENTION

The present invention has been made to cope with the aforementioned problems, and it is an object of the present invention to provide a cassette-type fuel tank which can be easily attached to a working machine, which is convenient for transporting and storing separately, and which is easily connected to a carburetor for feeding fuel thereto. Another object of the present invention is to provide a working machine which enables the aforementioned cassette-type fuel tank to be easily attached thereto.

For realizing the aforementioned objects, a cassette-type fuel tank according to the present invention is adapted to be removably attached to a working machine equipped with an internal combustion engine, with the fuel tank comprising an opening to which can be attached, selectively and exchangeably, either a closing cap for use in transporting the fuel tank separate from the working machine, or another closing cap for use when the fuel tank is attached to the working machine.

In a preferred embodiment of the cassette-type fuel tank of the present invention, the fuel tank is cylindrical in shape having a bottom, and having the opening at an end opposite to the bottom. The closing cap for use when the fuel tank is attached to the working machine is equipped with a fuel supply pipe and an air breather pipe, with both pipes being disposed to communicate with the interior and exterior of the fuel tank.

In a specific embodiment of the closing cap for use when the fuel tank is attached to the working machine, the one end of the fuel supply pipe which is disposed inside the fuel tank is connected with an end of a soft, flexible fuel supply tube (made of rubber or synthetic resin, for example) whose other end is provided with a weight. Also, the one end of the air breather pipe which is disposed inside the fuel tank is connected with an end of a soft, flexible air breather tube (made of rubber or synthetic resin, for example) whose other end is provided with a float. The other end of the air breather pipe which is disposed outside the fuel tank is provided with a breather.

The cassette-type fuel tank of the present invention can be transported or stored separate from the working machine, and can be readily attached to the working machine as a ready fuel supply. With a simple exchange of closing caps, and without a need to transfer fuel to a pre-installed fuel tank on the working machine, drawbacks such as soiling of the operator's hands are avoided.

Furthermore, since such a cassette-type fuel tank can be transported or stored separate from the working machine, it can be filled in advance with a gasoline-lubricating oil fuel mixture suited for use in a small two-stroke internal combustion engine, by a manufacturer of working machines, for instance. As a result, an optimally conditioned fuel mixture can be supplied to the internal combustion engine of a working machine, thus preventing the fuel mixture from being contaminated by dust particles and obviating the need for a fuel filter.

Since attachment of the present cassette-type fuel tank to the working machine can be effected by simply exchanging one closing cap (i.e. a cap for use in transporting the fuel tank separate from the working machine) for another closing cap (i.e. a closing cap for use when the fuel tank is attached to the working machine), resupplying fuel to the carburetor of the working machine is simplified.

Advantageously further, in a working machine equipped with a cassette-type fuel tank according to the present invention, a tank-mounting means for removably holding the fuel tank is disposed below the internal combustion engine. The tank mounting means is provided with a tank holder and with an elastic band. The tank holder is affixed at both ends to the bottom portion of the internal combustion engine, and the elastic band is attached by its one end to the tank holder. The other, free end of the elastic band is adapted to be removably engaged with a hook of the tank holder, for holding the fuel tank between the tank holder and the elastic band.

With such tank-mounting means, the fuel tank can be readily mounted on the working machine by simply engaging the free end of the elastic band with the hook of the tank holder. Removal of the fuel tank from the working machine can be readily effected also, by simply disengaging the free end of the elastic band from the hook.

DETAILED DESCRIPTION

A cassette-type fuel tank and a working machine equipped with the cassette-type fuel tank, each representing an embodiment of the present invention, will be explained in detail with reference to the drawings.

Figure 1:
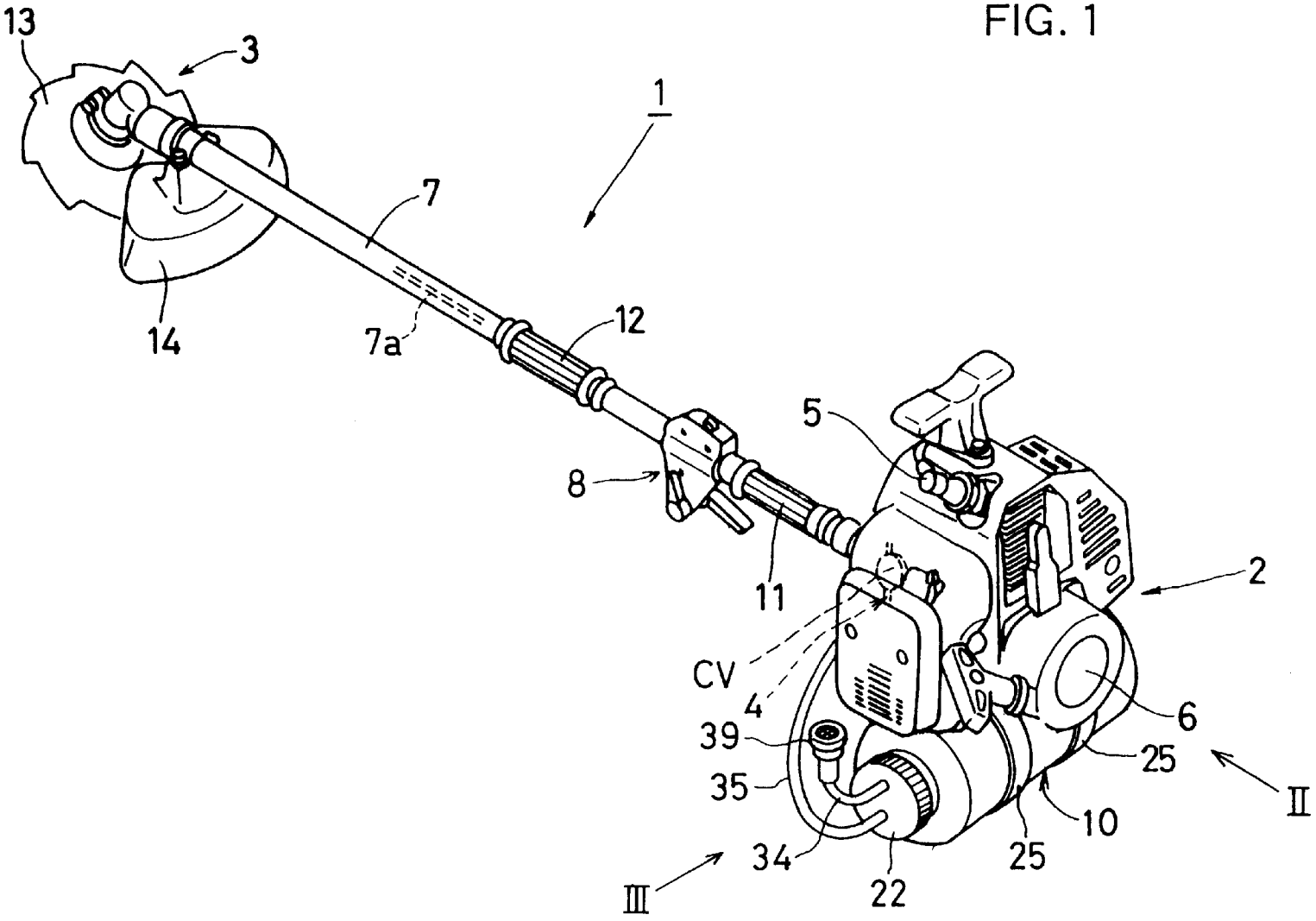
FIG. 1 is a perspective view of a bush cutter representing one example of a working machine wherein an embodiment of the cassette-type fuel tank according to the present invention is mounted on the working machine.

FIG. 1 shows a bush cutter as an example of a working machine with a fuel tank mounted in accordance with an embodiment of the invention. The bush cutter 1 comprises a working portion 3 which generally consists a cutting blade 13 attached to the distal end portion of a bar handle (operating rod) 7 provided with grip portions 11 and 12 which are separated by a predetermined distance, a safety cover 14 disposed near the cutting blade 13 and so on, and a hand lever apparatus 8 attached at an intermediate portion between the grip portions 11 and 12. The bush cutter 1 further comprises, at the proximal end of the bar handle 7, an internal combustion engine (e.g. a small air-cooled two-stroke gasoline engine) 2 which serves as a power source for driving the cutting blade 13 via a drive shaft 7*a* mounted inside the bar handle 7. The internal combustion engine 2 is equipped with a recoil starter 6, a carburetor 4 with a throttle valve CV, and a spark plug 5.

A cassette-type fuel tank 10 according to this embodiment is mounted at the bottom of the internal combustion engine 2.

Figure 2:
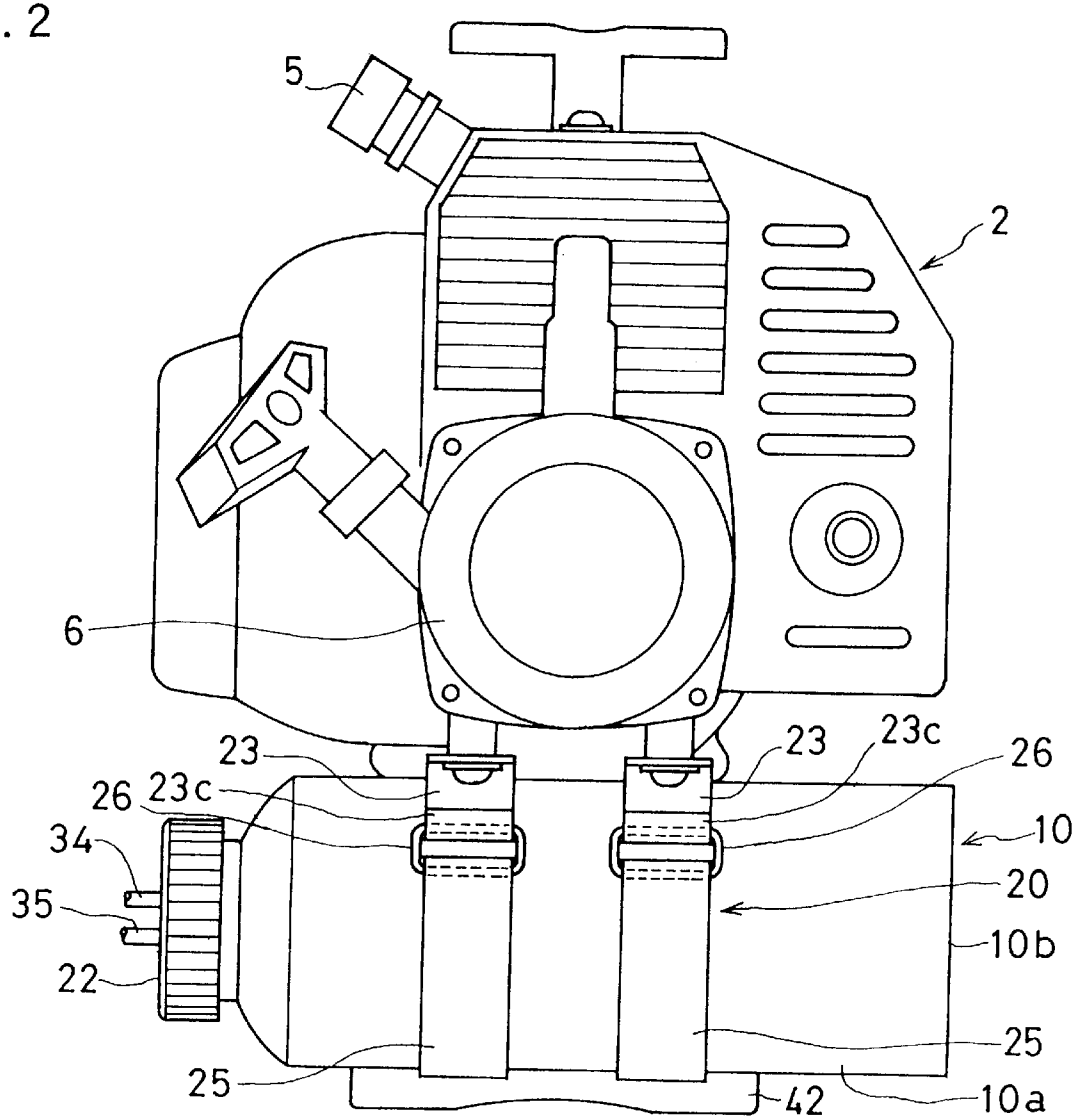
FIG. 2 is an end view of the bush cutter shown in FIG. 1, as viewed from the direction of the arrow II.
Figure 3:
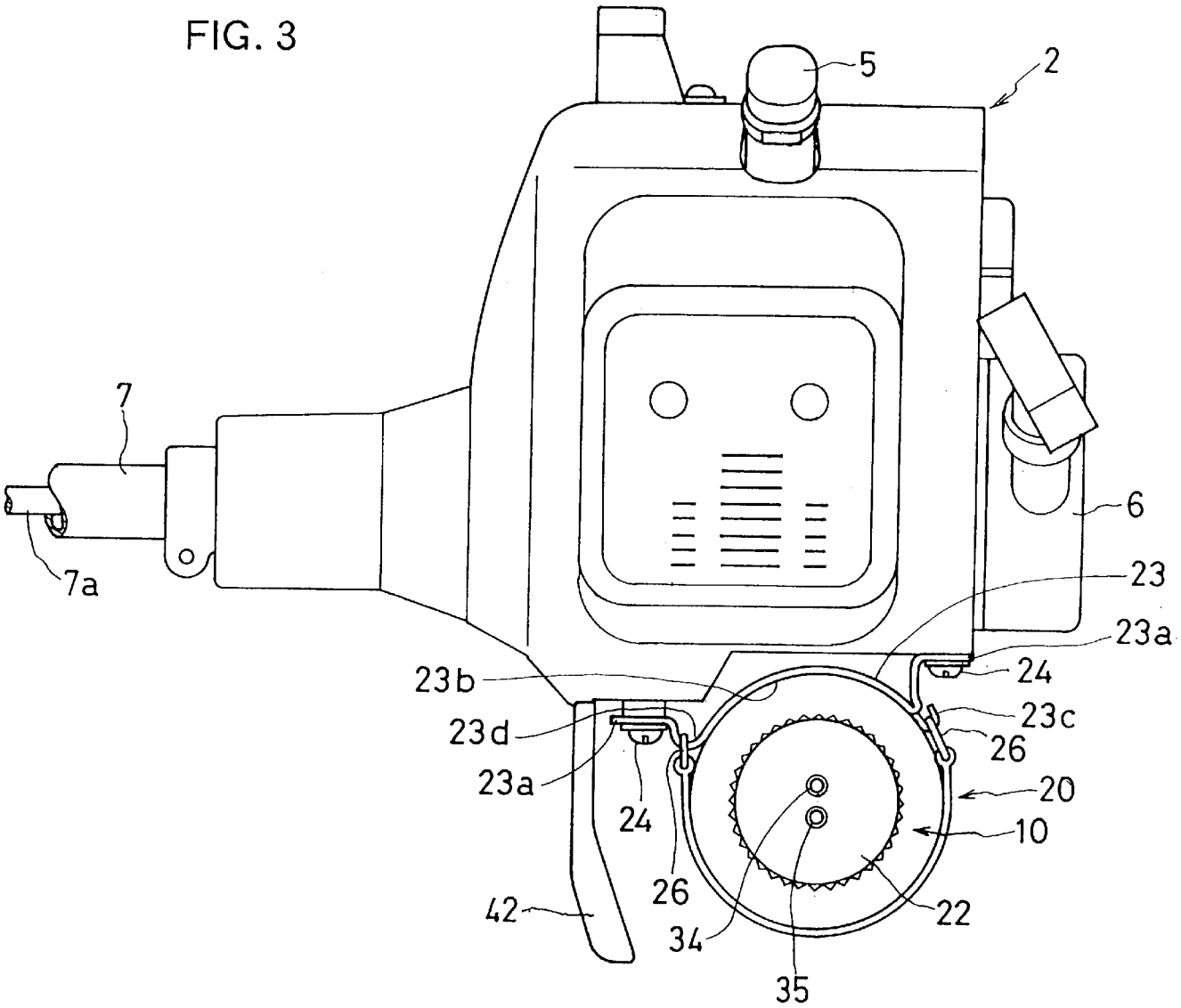
FIG. 3 is a left side view of the bush cutter shown in FIG. 1, as viewed from the direction of the arrow III.

The cassette-type fuel tank 10 is cylindrical in shape, comprising a cylindrical portion 10*a* and a bottom portion 10*b* as shown in FIGS. 2 and 3. An opening 21 (FIG. 4) is formed at the end opposite to the bottom portion 10*b*, and a closing cap 22 (i.e. a closing cap for use when the fuel tank 10 is attached to the bush cutter 1) is screwed onto the opening 21.

A tank-mounting means 20 is disposed below the internal combustion engine 2, with a pair of tank holders 23 spaced apart laterally, and with a pair of rubber bands (elastic bands) 25. The each end of each tank holder 23 is affixed by means of a fastening screw 24 to the bottom portion of the internal combustion engine 2. The middle portion of each tank holder 23 is formed into a concave portion 23*b* in which the side wall of the cylindrical portion 10*a* of the fuel tank 10 is received. The received fuel tank 10 is fastened to the tank holders 23 by the rubber bands 25 which are wrapped around the peripheral wall of the cylindrical portion 10*a* of the fuel tank 10.

The rubber bands 25 are provided with clamping rings 26 attached at both end portions of respective rubber band 25. The clamping ring 26 which is attached to the forward end of the rubber band 25 is affixed in advance to an angled portion 23*d* formed at the forward end portion of the concave portion 23*b*. The other clamping ring 26, which is attached to the rearward free end of the rubber band 25, is adapted to be engaged with a hook 23*c* attached to the rearward end portion of the concave portion 23*b* of the tank holder 23. Accordingly, the fuel tank 10 can be removably clamped with a suitable pressure to the tank holders 23 by engaging the clamping rings 26 attached to the free ends of the rubber bands 25 with the hooks 23*c* while somewhat stretching the rubber band 25.

Figure 4:
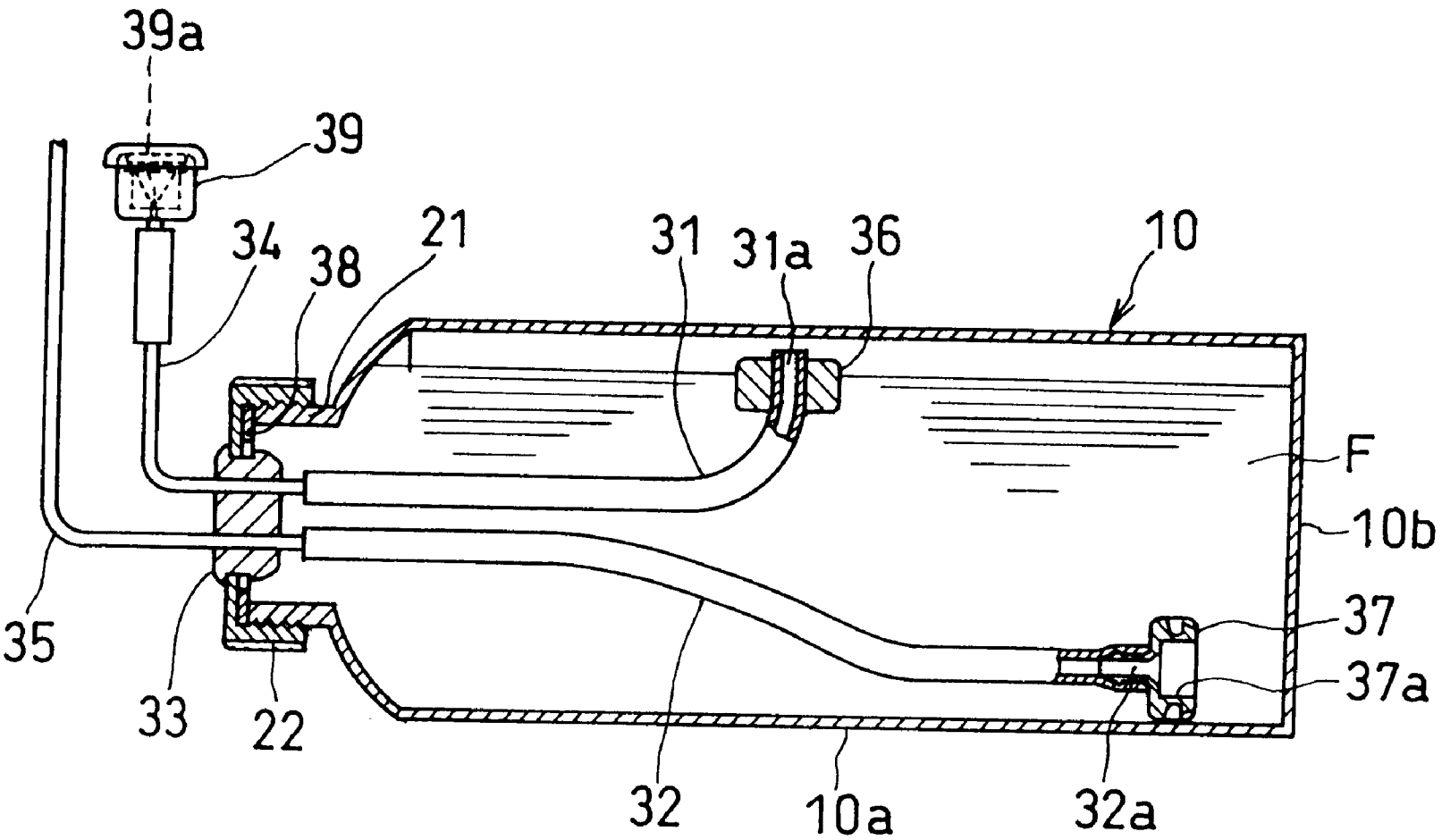
FIG. 4 is a cross-sectional view of the cassette-type fuel tank shown in FIG. 2.

FIG. 4 shows a sectional view of the cassette-type fuel tank 10 according to this embodiment, filled with a fuel mixture F consisting of gasoline and a lubricating oil mixed together in a predetermined ratio. The closing cap 22 (i.e. a closing cap for use when the fuel tank 10 is attached to the bush cutter 1) for the fuel tank 10 is screwed via a sealing member 38 onto the opening 21 of the fuel tank 10.

Attached to the closing cap 22 are a rigid air breather pipe 34 made of metal, for example, which is designed to be used for a breather, and a rigid fuel supply pipe 35 made of metal. The air breather pipe 34 and fuel supply pipe 35 penetrate through an elastic sealing holder 33 made of rubber or synthetic material, for example, so as to be held therein while permitting the interior of the fuel tank to communicate with the exterior of the fuel tank 10.

The cassette-type fuel tank 10 also includes an air breather tube 31 and a fuel supply tube 32, both of which are made of a soft flexible material such as rubber or synthetic resin, for example. One end of the air breather tube 31 is connected with an inner end of the air breather pipe 34, and the other end of the air breather tube 31 is provided with a float 36. One end of the fuel supply tube 32 is connected with an inner end of the fuel supply pipe 35, and the other end of the fuel supply tube 32 is provided with a weight 37 having an opening 37*a*.

The float 36 is designed to float, due to its buoyancy, on the fuel mixture F, so that an opening 31*a* formed at the aforementioned other end of the air breather tube 31 remains exposed to the air space above the level of the fuel mixture F. The weight 37 is designed to remain, due to its own weight, at the bottom of the fuel mixture F, thus maintaining an opening 32*a* of the aforementioned other end of the fuel supply tube 32 at the bottom of the fuel tank 10.

A breather 39 with a duckbill type check valve 39*a* is attached to the outer end of the air breather pipe 34, so that, when the interior pressure in the fuel tank 10 drops below the external atmospheric pressure, external air will enter via the breather 39 into the fuel tank 10, thereby equalizing the interior pressure in the fuel tank 10 to the external atmospheric pressure.

The fuel supply pipe 35 is connected with the carburetor 4 of the internal combustion engine 2, so that the fuel mixture F in the fuel tank 10 can be sucked through the opening 37*a* of the weight 37 and introduced into the carburetor 4 of the internal combustion engine 2.

Figure 5:
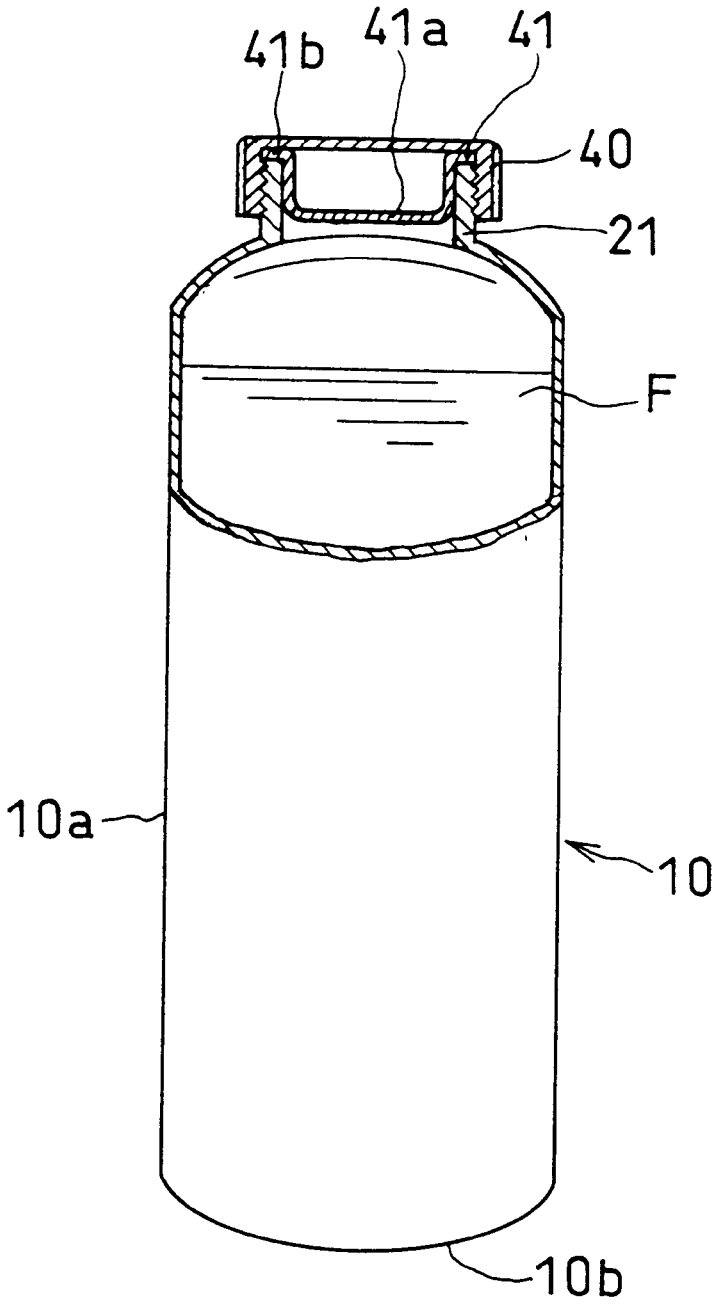
FIG. 5 is a partially sectioned perspective view of the cassette-type fuel tank according to one embodiment of the present invention.

FIG. 5 shows a partially sectioned view of the cassette-type fuel tank 10 before it is mounted on the bush cutter 1. After the fuel tank 10 is filled with a fuel mixture F through an opening 21 formed at the top of the cylindrical portion 10*a* with the bottom portion 10*b*, a sealing plug member 41 consisting of a fitting portion 41*a* and a flange portion 41*b* is inserted into the opening 21. Then, a closing cap 40 (i.e. a closing cap for use in transporting the fuel tank 10 separate from the bush cutter 1) is screwed firmly onto the thread portion formed on the outer wall of the opening 21, thus hermetically closing the opening 21. When the cassette-type fuel tank 10 is filled in advance with a fuel mixture F and hermetically closed as shown in FIG. 5, it can be transported separately to a work site such as a field separate from a working machine such as a bush cutter 1. Alternatively, the fuel tank 10 can be separately stored in a warehouse.

The cassette-type fuel tank 10 according to this embodiment is designed to be employed by mounting it on the internal combustion engine 2 of the bush cutter 1, for instance. When the fuel tank 10 is separately transported to a work site such as a field and then mounted on the bush cutter 1 at the work site, the closing cap 40 and the flange portion 41*b* first are removed from the opening 21 of the fuel tank 10, and then, as shown in FIG. 4, the closing cap 22 (i.e. a closing cap for use when the fuel tank 10 is attached to the bush cutter 1) is screwed onto the opening 21 instead. Pre-attached to the closing cap 22 are aforementioned components such as the metallic pipes 34 and 35, the flexible tubes 31 and 32, the float 36, the weight 37 and the breather 39.

Then, the cylindrical portion 10*a* of the fuel tank 10 is fitted into the concave portions 23*b* of the tank holders 23, and, with the rubber bands 25 wrapped around the cylindrical portion 10*a* of the fuel tank 10, the clamping rings 26 attached to the rubber bands 25 are engaged with the respective hooks 23*c* on the tank holder 23. As a result, the fuel tank 10 is clamped removably and with suitable pressure to the tank holders 23, thus effecting the mounting of the fuel tank 10 at the mounting portion 20 located below the internal combustion engine 2 of the bush cutter 1.

The reference numeral 42 in FIGS. 2 and 3 refers to a stand for protecting the fuel tank 10, for use when the working machine is to be laid on the ground.

In actual operation of the bush cutter 1, when the internal combustion engine 2 is started, the fuel mixture F in the fuel tank 10 is sucked out through the opening 37*a* of the weight 37 and fed to the carburetor 4 through the fuel supply tube 32 and fuel supply pipe 35. As a result, the amount of fuel mixture F in the fuel tank 10 is diminished, thus reducing the interior pressure in the fuel tank 10, and thus generating a negative pressure in the fuel tank 10. Due to the negative pressure, exterior air will be introduced through the breather 39 into the fuel tank 10 to compensate for the negative pressure, thus promoting a smooth supply of fuel mixture F from the fuel tank 10 to the carburetor 4.

Since the breather 39 has the duckbill type check valve 39*a,* the fuel mixture F is prevented from being discharged through the breather 39 from the fuel tank 10 into the atmosphere, even though air can enter into the fuel tank 10 from the atmosphere.

According to the cassette-type fuel tank of the present invention, since it is designed to be removably attached to a working machine such as a bush cutter, it can be transported or stored separate from the working machine then fuel can be readily supplied by simply attaching the fuel tank to the working machine. Therefore, a transfer of fuel to a fuel tank preinstalled on the working machine at a work site such as a field is no longer required, thus avoiding soiling of the operator's hands, for example.

Furthermore, since this cassette-type fuel tank can be transported or stored separate from the working machine, the cassette-type fuel tank can be filled in advance with a gasoline-lubricating oil fuel mixture suited for use in a small two-stroke internal combustion engine before it is supplied by a manufacturer of working machines, for instance. As a result, an optimally conditioned fuel mixture is fed to the internal combustion engine of a working machine. No transfer of fuel to a fuel tank preinstalled on the working machine is required, at a work site such as a field. As the fuel mixture will remain uncontaminated by dust particles, attachment of a filter to the fuel system of the internal combustion engine may be dispensed with.

The cassette-type fuel tank can be readied for attachment to the working machine by simply attaching a closing cap to the cassette-type fuel tank, with such closing cap being for use when the fuel tank is attached to the working machine and being provided in advance with an attached fuel supply system including a float, a weight, a breather, a fuel supply pipe and an air breather pipe. As a result, resupplying fuel to the carburetor of the engine is simplified.

Since the fuel tank is formed as a cylindrical body having a bottom and an opening at the end opposite to the bottom, it can be disposed horizontally or vertically as convenient in transport and storage.

Furthermore, the fuel tank can be readily attached to a working machine by simply engaging one end portion of each rubber band with a respective hook of the tank holder. Removal of the fuel tank from the working machine can be readily effected by simply disengaging the end portion of the rubber band from the hook.

While, in the foregoing, one embodiment of the invention has been described in detail for the purpose of illustration, it will be understood that the construction of the device can be varied without departing from the spirit and scope of the invention.

For example, although a bush cutter is described as one example of a working machine in the above embodiment, a fuel tank according to the present invention can be applied to any other kind of working machine equipped with an internal combustion engine.

Furthermore, the shape of the fuel tank according to the present invention is not confined to the aforementioned cylindrical body having a bottom and an opening at its end opposite to the bottom, but it may be variously modified.

As seen from the above description, a cassette-type fuel tank according to the present invention is constructed so that it can be easily and removably attached to a working machine, for handling as a unit. Therefore, the resupplying of fuel to the working machine can be effected readily and conveniently, and transportation and storage of fuel is simplified.

With the attachment of the fuel tank to a working machine including separate insertion into the fuel tank, of a fuel supply system for the carburetor of the internal combustion engine, the resupplying of fuel to the carburetor is facilitated.

We claim:

1. A cassette-type fuel tank assembly for supplying fuel to a carburetor of an internal combustion engine in a portable working machine, comprising:

a closing cap for an opening in the fuel tank;

a fuel line hermetically extending through a first opening in the closing cap; and a breather line hermetically extending through a second opening in the closing cap.

2. The assembly according to claim 1, wherein the fuel tank is cylindrical in shape having a bottom, and with the opening in the fuel tank being formed opposite to the bottom.

3. The assembly according to claim 1, wherein the fuel line comprises:

a fuel pipe having an end inside the fuel tank; and a fuel tube having first and second fuel-tube ends, with the first fuel-tube end being connected with the end of the fuel pipe inside the fuel tank.

4. The assembly according to claim 3, wherein the fuel line further comprises a weight which is attached at the second fuel-tube end.

5. The assembly according to claim 1, wherein the breather line comprises:

a breather pipe having an end inside the fuel tank; and a breather tube having first and second breather-tube ends, with the first breather-tube end being connected with the end of the breather pipe inside the fuel tank.

6. The assembly according to claim 5, wherein the breather line further comprises:

a float attached to the second breather-tube end; and a breather attached to the breather pipe at a further end of the breather pipe which is disposed outside the fuel tank.

7. A portable working machine in combination with the assembly according to claim 1, further comprising tank-mounting means for removably holding the assembly beneath the internal combustion engine.

8. The combination according to claim 7, wherein the tank-mounting means comprises:

a tank holder attached to a bottom portion of the internal combustion engine;

an elastic band wrapped at least partly around the tank holder, having an end which is attached to the tank holder, and having another end which is removably attached to the tank holder.

* * * * *